US006597319B2

(12) United States Patent
Meng et al.

(10) Patent No.: US 6,597,319 B2
(45) Date of Patent: Jul. 22, 2003

(54) ANTENNA DEVICE FOR A COMMUNICATION TERMINAL

(75) Inventors: Anders Meng, Soeborg (DK); Torben Kristensen, Frederiksberg (DK)

(73) Assignee: Nokia Mobile Phones Limited, Espoo (FI)

( * ) Notice: Subject to any disclaimer, the term of this patent is extended or adjusted under 35 U.S.C. 154(b) by 3 days.

(21) Appl. No.: 09/943,514

(22) Filed: Aug. 31, 2001

(65) Prior Publication Data

US 2002/0024470 A1 Feb. 28, 2002

(30) Foreign Application Priority Data

Aug. 31, 2000 (GB) ..... 0021449

(51) Int. Cl.[7] ..... H01Q 1/24
(52) U.S. Cl. ..... 343/702; 343/700 MS
(58) Field of Search ..... 343/702, 700 MS, 343/725, 767; 379/433; 455/90

(56) References Cited

U.S. PATENT DOCUMENTS

| | | | | |
|---|---|---|---|---|
| 4,238,800 A | | 12/1980 | Newington | 343/715 |
| 4,851,855 A | | 7/1989 | Tsukamoto et al. | 343/700 MS |
| 4,914,448 A | | 4/1990 | Otsuka et al. | 343/872 |
| 5,608,413 A | * | 3/1997 | Macdonald | 343/700 MS |
| 5,784,032 A | | 7/1998 | Johnston et al. | 343/702 |
| 5,995,052 A | * | 11/1999 | Sadler et al. | 343/702 |
| 6,081,239 A | | 6/2000 | Sabet et al. | 343/753 |

FOREIGN PATENT DOCUMENTS

| | | |
|---|---|---|
| EP | 0301216 | 6/1988 |
| EP | 0455493 | 5/1991 |
| EP | 0531164 | 9/1992 |
| EP | 0997974 | 9/1999 |
| GB | 2130018 | 9/1983 |
| WO | 91/02386 | 2/1991 |

* cited by examiner

*Primary Examiner*—James Clinger
(74) *Attorney, Agent, or Firm*—Antonelli, Terry, Stout & Kraus, LLP

(57) ABSTRACT

An antenna device comprising of two substantial planar and conductive elements where the first element is acting as the radiator of the antenna, and the second element is acting as the ground plane for the radiator of the antenna, said two conductive elements are mounted substantially in parallel by means of a non-conductive housing, and said radiator of the antenna is facing towards the ground plane of the antenna with the cavity in between the first and second conductive elements being filled with air.

12 Claims, 3 Drawing Sheets

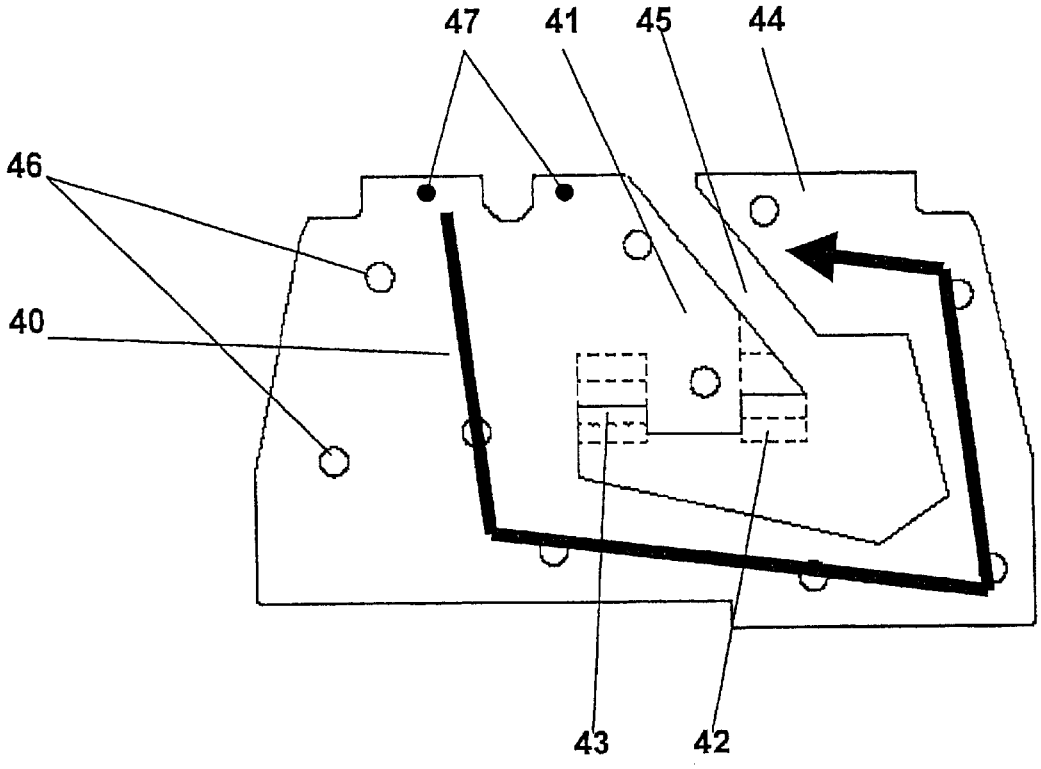
Fig. 4
Fig. 5
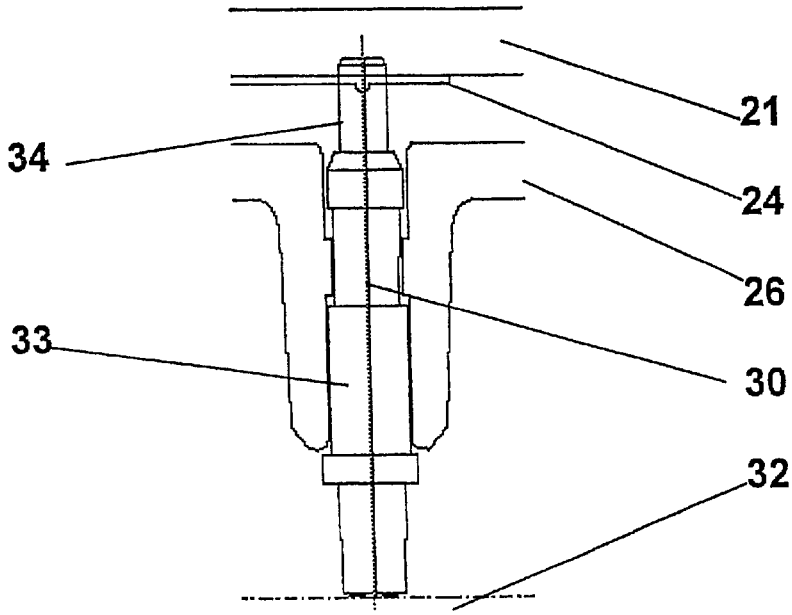

ANTENNA DEVICE FOR A COMMUNICATION TERMINAL

BACKGROUND OF THE INVENTION

1. Field of the Invention

The invention relates an antenna device for a communication terminal, e.g. hand-portable phone.

2. Description of Prior Art

During the past years use of internal antennas for cellular terminals has become more and more popular among the users. Today approximately 50% of the manufactured phones are equipped with internal antennas.

SUMMARY OF THE INVENTION

According to a first aspect of the invention there is provided an antenna device comprising two substantial planar and conductive elements where the first element is acting as radiator of the antenna, and the second element is acting as ground plane for the radiator of the antenna, said two conductive elements are mounted substantial in parallel by means of a non-conductive housing, and said radiator of the antenna is facing towards the ground plane of the antenna with the cavity in between the first and second conductive elements being filled with air. Hereby there is provided a structure that reduces the dielectric loss in the antenna. This increases the efficiency of the antenna.

According to a second aspect of the invention there is provided an antenna device comprising radiator elements integrated into a single radiator plate of a patch antenna being operable in at least two frequency bands said antenna comprises adjustment parts for individually adjusting said at least two bands by adjusting the size of these adjustment parts during manufacturing. Hereby the two bands of the antenna are designed so independent tuning of GSM frequencies and PCN frequencies is obtained. GSM is tuned by changing the length of the signal path by making the slot bigger, though at the same time making the PCN stub area smaller. By having such a design the PCN resonance frequency will be almost constant when making a GSM tuning.

According to a third aspect of the invention there is provided a method of adjusting the resonance frequency of at least two frequency bands of an antenna device comprising radiator elements integrated into a single radiator plate of a patch antenna being operable in at least two frequency bands and having adjustment parts that individually affects the frequency of said at least two bands in dependence of the size of these adjustment parts, said method comprises steps of individually adjusting the size of adjustment parts. Hereby the antenna design is prepared for long term variation of the transmitter stage. If the transmitter stage changes output characteristics—e.g. due to the use of a new Power Amplifier from another vendor, the manufacturer is hereby provided with a method for matching the antenna device to these new characteristics instead of having to re-design the antenna due to the new components.

Furthermore the antenna is designed to have the highest voltage in the top of the phone in order to minimize coupling to the battery. The coupling between the end of the GSM part and the PCN stub is minimized in order to increase bandwidth of the antenna. The simple structure of the radiator gives the current a natural flow on the patch, which increases the bandwidth of the antenna.

BRIEF DESCRIPTION OF THE DRAWING

For a better understanding of the present invention and to understand how the same may be brought into effect reference will now be made by way of example only to the accompanying drawings in which:—

FIG. 4 shows in a plan view a preferred embodiment of an antenna device according to the invention.

FIG. 5 shows an antenna connector pin for use in an antenna device according to the invention.

DETAILED DESCRIPTION OF THE INVENTION

Figure 1:
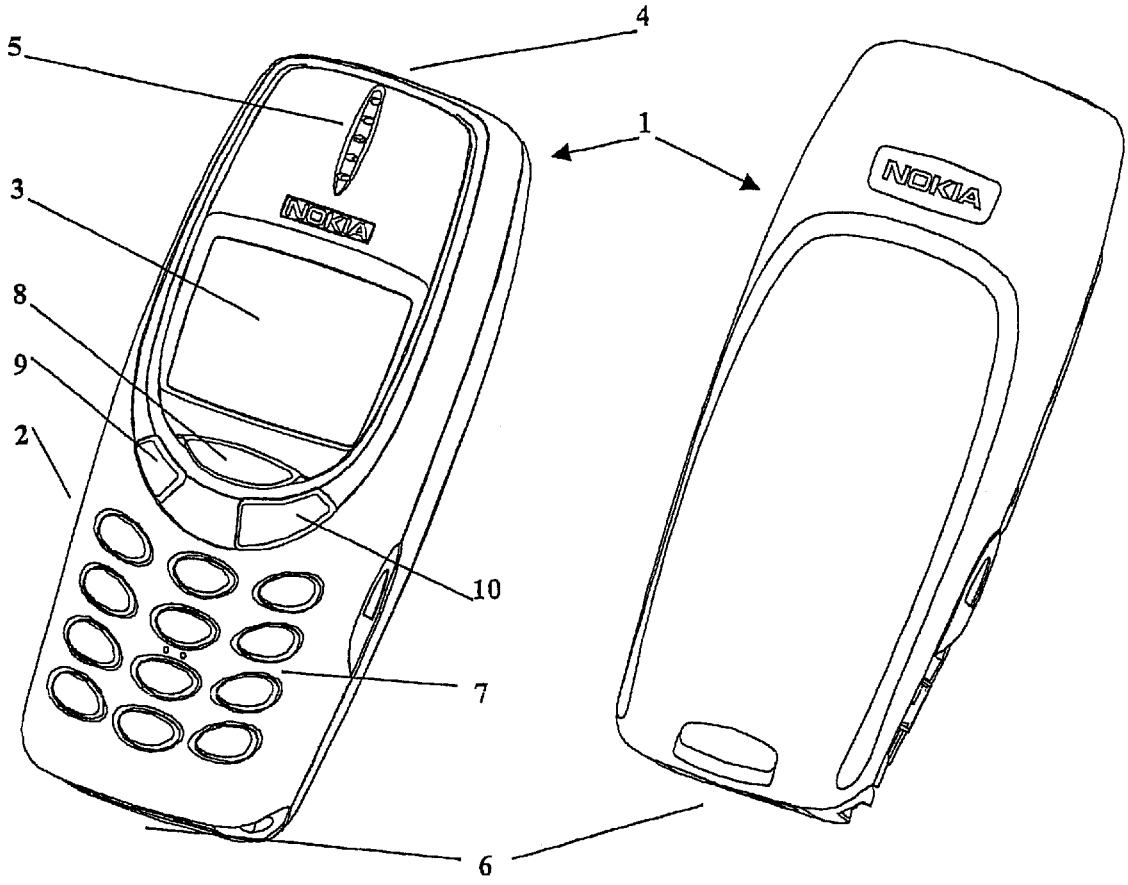
FIG. 1 illustrates a preferred embodiment of a communication terminal according to the invention.

FIG. 1 shows a preferred embodiment of a phone according to the invention, and it will be seen that the phone, which is generally designated by 1, comprises a user interface having a keypad 2, a display 3, an on/off button 4 (present in the top of the phone and therefore not visible in the present view), a speaker 5, and a microphone 6 (openings present in the bottom of the phone and therefore not visible in the present view). The phone 1 according to the preferred embodiment is adapted for communication via a cellular network, such as the GSM 900/1800 MHz network.

According to the preferred embodiment the keypad 2 has a first group 7 of keys as alphanumeric keys, one softkey 8, a cursor navigation key 10 (scroll up/down), and a "clear"-key 9 for erasing letters in text in the display 3, jumping steps down in the menu structure and rejecting calls. The present functionality of the soft key 8 is shown in separate fields (softkey-label) in the display 3 just above the softkey 8. The softkey 8 is a multifunction key and its present function depends on the state of the phone 1. The softkey 8 gives access to the menu, the phonebook and call handling.

Figure 2:
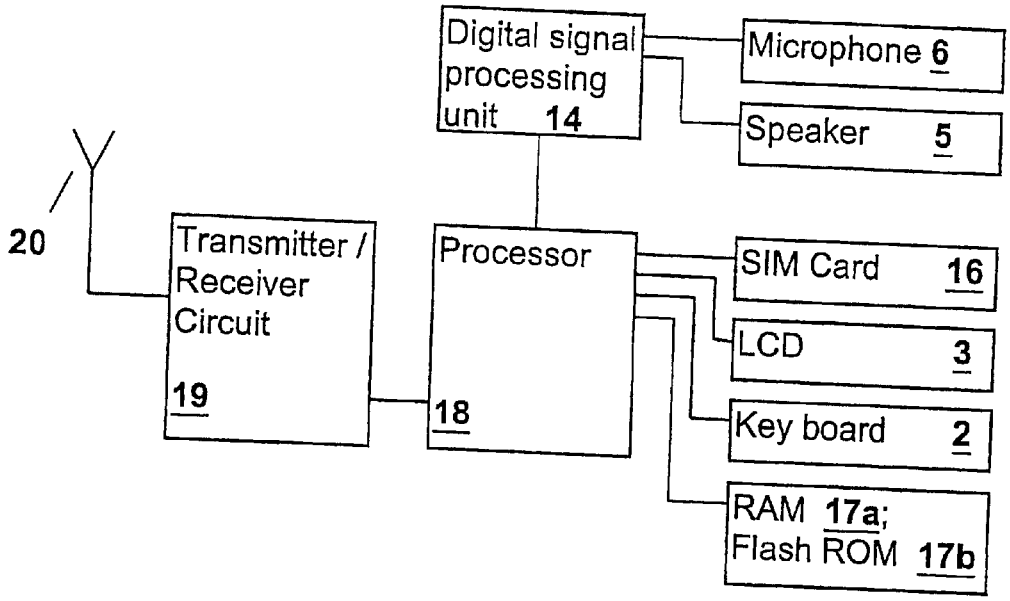
FIG. 2 schematically shows the essential parts of a communication terminal for communication with a cellular network.

FIG. 2 schematically shows the most important parts of a preferred embodiment of the phone, said parts being essential to the understanding of the invention. The processor 18 controls the communication with the network via the transmitter/receiver circuit 19 and an internal antenna 20.

The microphone 6 transforms the user's speech into analogue signals, the analogue signals formed thereby are A/D converted in an A/D converter (not shown) before the speech is encoded in a digital signal processing unit 14 (DSP). The encoded speech signal is transferred to the processor 18, which i.a. supports the GSM terminal software. The processor 18 also forms the interface to the peripheral units of the apparatus, including a RAM memory 17*a* and a Flash ROM memory 17*b*, a SIM card 16, the display 3 and the keypad 2 (as well as data, power supply, etc.). The digital signal-processing unit 14 speech-decodes the signal, which is transferred from the processor 18 to the earpiece 5 via a D/A converter (not shown).

Figure 3:
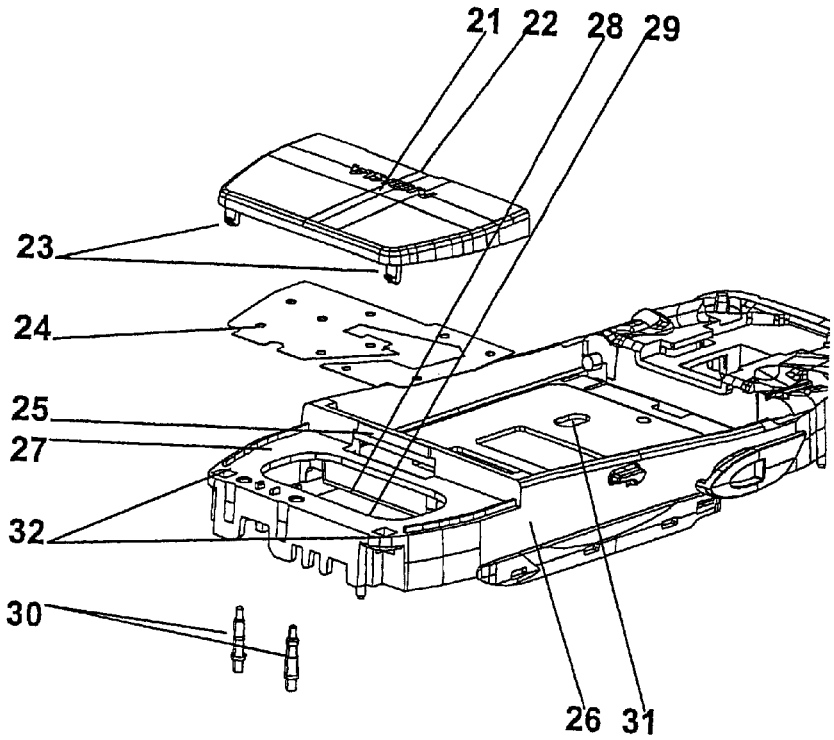
FIG. 3 shows in exploded view a communication terminal according to the invention.

The antenna according to the preferred embodiment of the invention is a PIFA (Planar Inverted F-Antenna) and includes an ground plane being provided by the shield 29 of the Printed Circuit Board (PCB) of the phone, one radiator plate 24 mounted on an antenna blank 21 and two pogopin connectors 30. The antenna structure is shown in FIG. 3. The antenna blank is made of IXEF (the IXEF compounds are a family of semi-crystalline polyarylamide thermoplastics reinforced with glass fibers and/or mineral fillers essentially for injection molding and manufactured by Solvay) and the radiator plate of 0.15 mm thick new silver. Ultrasonic welding (depending on vendor) assembles the two parts.

An inner cover 26 of the phone 1 is preferably also made of the same resin as the antenna blank 21. The antenna blank 21 has two taps 23 for being received in two channels 32 provided in the inner cover 26. When the tabs 22 are received in the channels 32, the blank 21 may follow a guided movement towards the closed position, where a tongue 22 of the antenna blank 21 cooperates with a recess 25 on the inner cover 26 for providing a snap connection between the antenna blank 21 and the inner cover 26.

Just below the antenna cavity 28 there is provided a battery cavity 31 for receiving a battery box (not shown).

The front and rear covers of the phone are visible in FIG. 1 but are removed in FIG. 3. The front and rear covers are of the type described in GB 9903260.9.

The two pogopin connectors 30 are shown in enlarged scale in FIG. 5. The pogopin connectors 30 are provided as spring loaded contacts with bleeding holes in the base contact (barrel), it consists of a metal barrel 33, an internal metal spring (not visible) and a plunger 34 (moving part). The spring in the connector is under constant load in contact position.

The antenna blank 21 is clicked on the inner-cover frame 26 of the phone. This construction avoids the dielectric body of the antenna (antenna blank) being placed between the radiator plate 24 and the ground plane of the antenna (PCB-shield 29). This structure is important to reduce the dielectric loss in the antenna. The dominating part of the field generated by the antenna will be between the radiator plate 24 and the ground plane (shield 29). By not having dielectric material in this area the loss is reduced. The dielectric properties of the antenna blank 21 are still important for the performance. The permittivity of the IXEF material is approximately 4 and it does load the antenna. This type of antenna structure may be called a superstrate loaded antenna (without or substantially without dielectric material between the radiator plate 24 and the ground plane (shield 29).

By providing the antenna blank 21 as a "snap on" structure it will be possible to access the radio signal on the assembly line at the factory in order to verify the performance of the transmitter 18. Therefor there is no need to provide a separate RF-connector, which is usually used for performance verification. By being able to remove the antenna relatively easily, it is made possible to connect test equipment to the radio transmitter through the antenna connectors—both during the manufacturing and at after market service.

In design of the radiator shape a number of aspects must be taken into account. First of all the battery, which during use is placed in the battery cavity 31, has a large influence on antenna performance. Also it should be designed so that influence of hand and fingers of the user is minimised. The way these things are handled is to put the high voltage point (the end 44 of the GSM part) of the patch at the top of the phone—as far away from the battery as possible. The high voltage point of the patch turned out to be the one having the biggest coupling to the battery.

The feeding points of the antenna 47 are provided close to the top of the antenna. The ground pin is closest to a slot 45 and the signal pin starts a quarter wave resonant element.

This antenna has a part—indicated by an arrow 40—corresponding to the GSM part, which is "active" in both bands (900 MHz and 1800 MHz). In GSM (900 MHz) this part 40 corresponds to quarter wave resonance, while in PCN (1800 MHz) the part has a higher order resonance. A part corresponding to PCN part is a PCN match stub 41. The PCN match stub 41 matches the higher order resonance of the PCN band. This antenna can basically be described by a U-shaped GSM part 40 and a PCB match stub 41 between the two arms of the U-shaped GSM part 40.

The patch antenna is constructed in such a way it can be tuned quite independently in the two bands. In PCN it is a question of making the PCN stub shorter or longer. By removing one or more of the dotted parts of the PCN adjustment part 42, the PCN frequency will increase without affecting the GSM frequency. In GSM the unique feature of making the slot longer at the same time reduces the size (area) of the PCN stub. This means that even though the PCN frequency is tuned down by making the slot longer and this effect is balanced out by reducing the size of the PCN stub 41.

The radiator plate 24 is punched out of a metal sheet and mounted to the inner surface of the antenna blank 21. This mounting is done by means of ultra sonic welding of the tab on the blank 21 extending through a plurality of holes 46 of the radiator plate 24. The form of the radiator plate 24 is shown in FIG. 4. Hereby it becomes possible during manufacture to adjust the match of the PCN band of the antenna by cutting off smaller or bigger parts of the PCN adjustment part 42. In design of this antenna, bandwidth is an important parameter. In order to enhance the bandwidth, the distance between the end 44 of the GSM part and the PCN stub is separated as far as the area allows. This distance (the width of the slot 45) may be reduced to tune down the resonance frequency since coupling is increased. However in order to keep a sufficient bandwidth it is preferred to keep distance between the two parts above a certain level. Another bandwidth enhancing feature is to keep the structure as simple as possible in the sense that the current should avoid making strong bends. This has influence on the GSM part but is less critical for the PCN stub.

By removing one or more of the dotted parts of the GSM adjustment part 43, the GSM frequency will decrease without affecting the PCN frequency. The current path for GSM will increase. The same will count for the PCN current path, but the size reduction of the PCN stub 41 will compensate for this.

The main effects of the antenna describe above is the highest voltage is designed for the top of the phone in order to minimise coupling to the battery. Furthermore the coupling between the end of the GSM part and the PCN stub is minimised in order to increase the bandwidth of the antenna. The two bands of the antenna are designed so independent tuning of GSM and PCN is obtained. GSM is tuned by changing the length of the signal path by making the slot bigger, though at the same time making the PCN stub area smaller.

By having such a design the PCN resonance will be almost constant when making a GSM tuning. The simple structure of the radiator gives the current a natural flow on the patch, which increases the bandwidth of the antenna.

What is claimed is:

1. An antennal device comprising:

two substantial planar and conductive elements, wherein a first element is acting as a radiator of the antennal, and a second element is acting as a ground plane for the radiator of the antenna, wherein said two conductive elements are mounted in a fixed manner to be substantially in parallel to each other by a non-conductive housing, wherein said radiator of the antenna is facing towards the ground plane of the antenna with a cavity in between the first and second conductive elements being filled with air, and wherein the non-conductive housing is provided as a box having a lid on which the radiator of the antenna is mounted on the inner side.

2. An antenna device according to claim 1 where the lid is replaceable mounted onto the box by using snap on mechanism.

3. An antenna device according to claim 2, wherein the box is provided with an inner collar on which the lid rests, said collar is provided in order to stabilize the box and has central aperture providing a cavity between the two conductive elements substantially free of dielectric materials.

4. An antenna device according to claim 3, wherein said radiator includes first and second parts, and wherein the first part is terminated adjacent to the second part, and said termination of the first part is separated by a slot.

5. An antenna device according to claim 2 where the feeding points for the radiator is exposed when the lid is removed.

6. An antenna device according to claim 2, wherein said radiator includes first and second parts, and wherein the first part is terminated adjacent to the second part, and said termination of the first part is separated by a slot.

7. An antenna device according to claim 1 where the feeding points for the radiator is exposed when the lid is removed.

8. An antenna device according to claim 7, wherein the box is provided with an inner collar on which the lid rests, said collar is provided in order to stabilize the box and has central aperture providing a cavity between the two conductive elements substantially free of dielectric materials.

9. An antenna device according to claim 7, wherein said radiator includes first and second parts, and wherein the first part is terminated adjacent to the second part, and said termination of the first part is separated by a slot.

10. An antenna device according to claim 1, and comprising radiator elements integrated into a single radiator plate of a patch antenna being operable in at least two frequency bands said antenna comprises adjustment parts for individually adjusting said at least two bands by adjusting the size of these adjustment parts during manufacturing.

11. An antenna device according to claim 10, wherein said radiator includes first and second pads, and wherein the first part is terminated adjacent to the second part, and said termination of the first part is separated by a slot.

12. An antenna device according to claim 1, wherein the highest voltage on the radiating element is provided at the end of the device being as far away from the battery of the unit in which the antenna device is used in order to minimize coupling to the battery.

* * * * *